United States Patent [19]

Kakitani et al.

[11] 4,365,887

[45] Dec. 28, 1982

[54] SHEET DISTRIBUTION METHOD AND APPARATUS

[75] Inventors: Yohtaro Kakitani; Tamaki Kaneko; Sunao Ikeda; Tugio Okuzawa; Hideo Kikuchi; Kunio Hibi, all of Tokyo, Japan

[73] Assignee: Ricoh Company, Ltd., Tokyo, Japan

[21] Appl. No.: 189,453

[22] Filed: Sep. 22, 1980

[30] Foreign Application Priority Data

Apr. 14, 1980 [JP] Japan ..... 55-48094

[51] Int. Cl.[3] ..... G03G 15/00

[52] U.S. Cl. ..... 355/14 R; 271/256; 355/3 SH; 355/77

[58] Field of Search ..... 355/14 R, 14 SH, 3 SH, 355/77; 271/256, 258, 259, 288, 257

[56] References Cited

U.S. PATENT DOCUMENTS 4,231,567 11/1980 Ziehm ..... 271/259

4,247,193 1/1981 Kaneko et al. ..... 355/14 R

*Primary Examiner*—R. L. Moses

*Attorney, Agent, or Firm*—David G. Alexander

[57] ABSTRACT

A sheet distribution method is provided which, when a stop switch (20) to stop a copying operation of a copying machine (1) or an interrupt switch (21) to interrupt the copying operation is depressed during the copying operation in a collation mode or an assortment mode, inhibits any further copying operation while keeping only a copy sheet conveyor section operative to deliver already fed copy sheets to a collator 82). When the number of copy sheets stored in the collator (2) has coincided with the number of fresh sheets fed out of the copying machine (1) during that copying operation, the conveyor section is made inoperative and the next copy start and variation in the operating mode of the machine (1) or preset number of sheet to be copied are permitted.

15 Claims, 3 Drawing Figures

SHEET DISTRIBUTION METHOD AND APPARATUS

BACKGROUND OF THE INVENTION

The present invention relates to a sheet distribution method and apparatus for performing sheet distribution operations such as collating and sorting.

Generally, a collating apparatus or collator for use with a copying machine has a plurality of sheet storing bins arranged one upon another and operates in a collation mode to distribute a set of copy sheets one by one into individual bins. The collator is also operable in a sorting or assortment mode in which copy sheets are fed or delivered successively into a single bin until a predetermined number is reached and then copy sheets are fed in the same way to the next bin.

A copying machine with such a collator is usually equipped with a stop switch to stop a copying operation or a series of copying cycles and an interrupt switch to interrupt or suspend a series of copying cycles halfway. With a copying machine having such switches, a copying operation or a series of copying cycles is usually determined as ended when the final copying action (a return of the optical unit) has been completed after the depression of the stop switch or the interrupt switch. Then the copying machine permits a copy start for another document or variation in the operating mode thereof, present number of sheets to be copied etc.

Further, the copying machine has such a design that there is a relatively long copy conveyance path including the copying machine body and collator. This inherent design brings about the following problem where sheets become jammed in such a conveyance path.

To make the description simple, suppose that an intended number of copies N is "9", that the 8th and 9th copy sheets or copies of the 5th page are travelling in the conveyance path in the collator, and that the 1st, 2nd and 3rd copies of the 6th page are moving simultaneously in the copying machine body.

When jamming occurs in the collator, the conveyance drive in the collator will be interrupted to allow only the three copy sheets or copies in the copying machine body to be discharged into a temporary discharge tray. The copy sheets in the collator on the other hand are wasted as jammed sheets. This is because it is quite difficult to exactly determine how many copies will be actually lost or to correlate the wasted copies with proper original documents. Thus, the 8th and 9th copies of the 5th page of the document are handled as jammed sheets. Accordingly, if manual insertion means or a feeder section is used in the above situation to cause the collator to collate the copies in the temporary discharge tray or the copying machine is energized, copies will be fed to the 8th and 9th bins of the collator in the wrong order, that is, the order of pages will be disrupted. This is because the copies in the temporary discharge tray or those fed from the copying machine body are not of the 5th page but of the 6th page.

In such a case, it is very troublesome to determine whether the jammed copies belong to the 5th page or the 6th page and the discrimination may become practically impossible depending on the construction of the collator. Furthermore, the operation must undertake quite intricate manipulation for re-loading the 5th document to re-copy it and then loading the 6th document to re-copy it.

Meanwhile, in a copying machine with an ADH, the ADH feeds documents one by one from a document tray to a copying position and, in this position, one copy or a series of copies are made. Thereafter, the document in the copying position is automatically returned to the tray while the next document if present is transferred to the copying position on a glass platen to undergo the same procedure.

A copying machine of the conventional design is operated for a high-speed continuous process such that a document on the glass platen is fed back to the document tray before the last copy thereof is delivered to a bin of the collator and the next document is fed to the glass platen. Accordingly, by the time jamming occurs in the collator during collation of the copies of the 1st page for example, the ADH will have already replaced the 1st document with the second despite the fact that the actual number of copies of the 1st page is short by the number of wasted copies, that is, the 1st document or page needs be re-copied to compensate for the shortage. This has heretofore been coped with by replacing the 2nd document with the 1st document.

It will thus be seen that the system which automatically returns a document by ADH in the event of jamming may damage valuable documents and renders the mechanism of the document handler disproportionately complex.

In this connection, a copy start may be permitted after the confirmation that the last copy sheet of a series of copy sheets of the same document page has reached a certain bin in the collator. It will be seen, however, that this method is disadvantageous in the following aspect.

The copying machine is operable not only in the described assortment or collation mode but in a usual or standard copying mode in which copy sheets from the copying machine will be simply stacked on a discharge tray instead of the delivery to the bins of the collator. This mode of operation is commonly employed to obtain copies of the same document page or those of a part of multiple different documents.

This means that in the usual copying mode the number of desired copy sheets is relatively small and, therefore, sheet jams can be dealt with easily compared with the collation and assortment modes. For this reason, it is needless in the usual copying mode to permit a copy start only after the last one of copy sheets of the same page has been found stored in a bin of the collator. Rather, it is desirable to give priority to the copying rate and allow the next copy start when the number of fresh sheets supplied (number of copy sheets of the same page) coincides with the present number of sheets to be copied.

SUMMARY OF THE INVENTION

A sheet distrubution method embodying the present invention comprises the steps of (a) providing at least one of a stop switch to stop a copying operation or cycle in the copying machine and an interrupt switch to interrupt a copying operation or cycle in the copying machine, (b) when said at least one of the switches is depressed, stopping the copying operation to inhibit a next copying operation following the copying operation and then continuing feeding operation of copy sheets into separate bins of a collator, (c) when a number of copy sheets fed from the copying machine is equal to a number of copy sheets stored in the bins, stopping the feeding operation, and (d) releasing the copying operation from being stopped to enable the copy start of the next copying operation.

A sheet distribution apparatus for use with a copying machine embodying the present invention comprises a plurality of bins into which a plurality of sets of sheets are discharged, a stop switch for stopping a copying operation or cycle in the copying machine, an interrupt switch for interrupting a copying operation or cycle, a first means for inhibiting a next copying operation following the copying operation and then continuing feeding operation of copy sheets into the bins when at least one of the stop and interrupt switches is depressed, a second means for stopping the feeding operation of the copy sheets when a number of the copy sheets fed from the copying machine is equal to a number of the copy sheets stored in the bins, and a third means for releasing the copying operation from being stopped to enable the copy start of the next copying operation.

In accordance with the present invention, when a stop switch to stop a copying operation or cycle or an interrupt switch to interrupt the copying operation or cycles is depressed during the copying operation in a collation mode or an assortment mode, any further copying operation is inhibited while only a copy sheet conveyor section is kept operative to deliver already fed copy sheets to a collator. When the number of copy sheets stored in the collator has coincided with the number of fresh sheets fed out of the copying machine during that copying operation, the conveyor section is made inoperative and the next copy start and variation in the operating mode of the machine or preset number of sheets to be copied are permitted.

It is an object of the present invention to provide an improved sheet distribution method and apparatus for use with a copying machine which is capable of during copying operaton, not only stopping the copying operation of the copying machine but also interrupting or suspending the copying operation.

It is another object of the present invention to, upon a stopping action during copying operation, allow the operating mode and the number of sheets preset before the stop to be stored or memorized.

It is another object of the present invention to, upon an interruption action during copying operation, not only allow the operating mode, the number of sheets preset before the interruption to be stored or memorized but also allow the operating mode and the number of sheets copied during copying operation for the interruption to be stored or memorized.

It is another object of the present invention to, after a stop or an interruption during copying operation, permit the operating mode before the stop or interruption to be regained and another copy start to be effected.

It is another object of the present invention to give priority to speeding up of the copying operation in a usual copying mode and to the ease of settlement of sheet jams in a collating or assortment mode.

It is another object of the present invention to provide a generally improved sheet distribution method and apparatus.

Other objects, together with the foregoing, are attained in the embodiment described in the following description and illustrated in the accompanying drawing.

DESCRIPTION OF THE PREFERRED EMBODIMENT

While the sheet distribution method and apparatus of the present invention are susceptible of numerous physical embodiments, depending upon the environment and requirements of use, substantial numbers of the herein shown and described embodiment have been made, tested and used, and all have performed in an eminently satisfactory manner.

Figure 1:
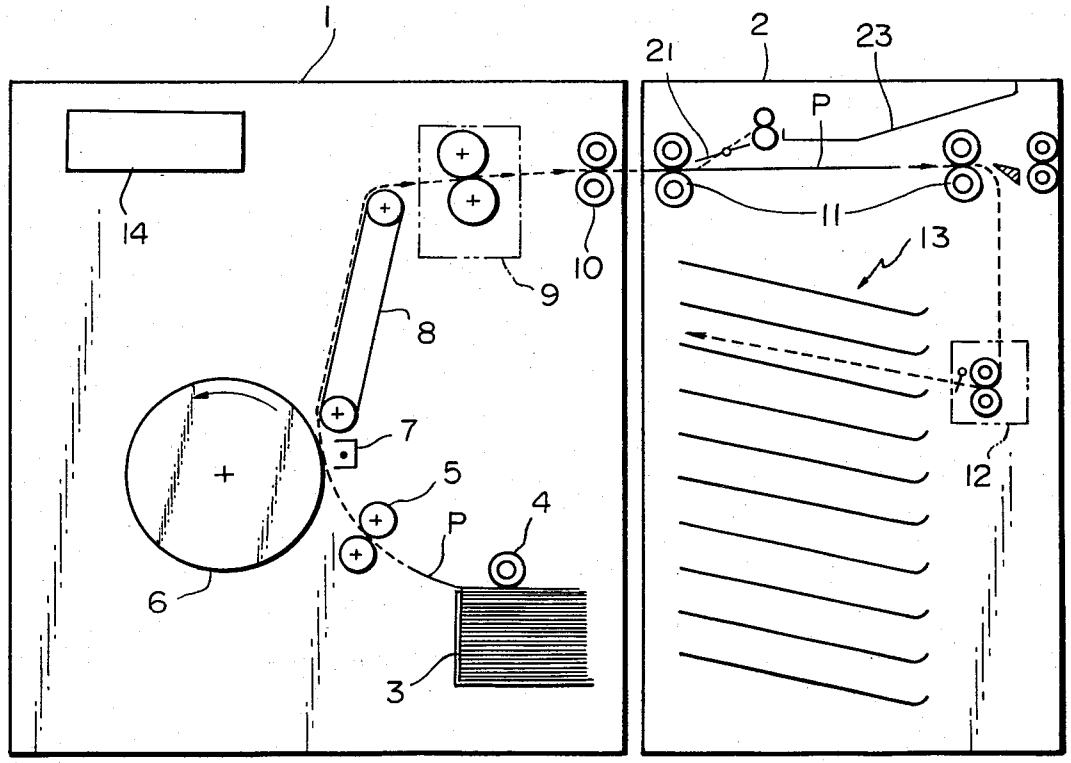
FIG. 1 schematically shows a copying machine with a collating apparatus to which the sheet distribution method and apparatus according to the present invention has been applied.

Referring to FIG. 1, there is shown a copying system to which the sheet distribution method and apparatus according to the present invention have been applied. As shown, the copying system is made up of a copying machine 1 and a collator 2.

The copying machine 1 produces copy sheets in a well known manner. Sheet feed rollers 4 supply sheets P one by one from a sheet cassette or tray 3 on which the sheets are stacked. Registration rollers 5 then drive the sheet to a determined transfer station in properly timed relation with a toner image carried on a photosensitive drum 6 and directed also toward the transfer station. At the transfer station, a transfer charger 7 causes the toner image on the drum 6 to be transferred onto the sheet P. In FIG. 1, charging, exposing and developing stations are not shown for the sake of simplicity.

The copy sheet P now carrying the toner image is conveyed by a belt 8 to a fixing unit 9 and, there, has the toner image fixed thereon. From the fixing unit 9, the sheet P is driven by discharge rollers 10 out of the copying machine 1 and into the collator 2 with its image surface facing upward.

In the collator 2, a sheet conveyor section 11 carries the incoming copy sheet P to a deflecting unit 12. Then the deflecting unit 12 turns the copy sheet P substantially 180° to cause the imaged surface of the sheet to face downward and delivers it into selected one of multiple sheet storage bins 13. In the same way, other copy sheets arriving at the collator 2 successively will be distributed by the deflector 12 into other determined bins.

The copying machine 1 includes a manipulatable control section 14 having various switches thereon.

Figure 2:
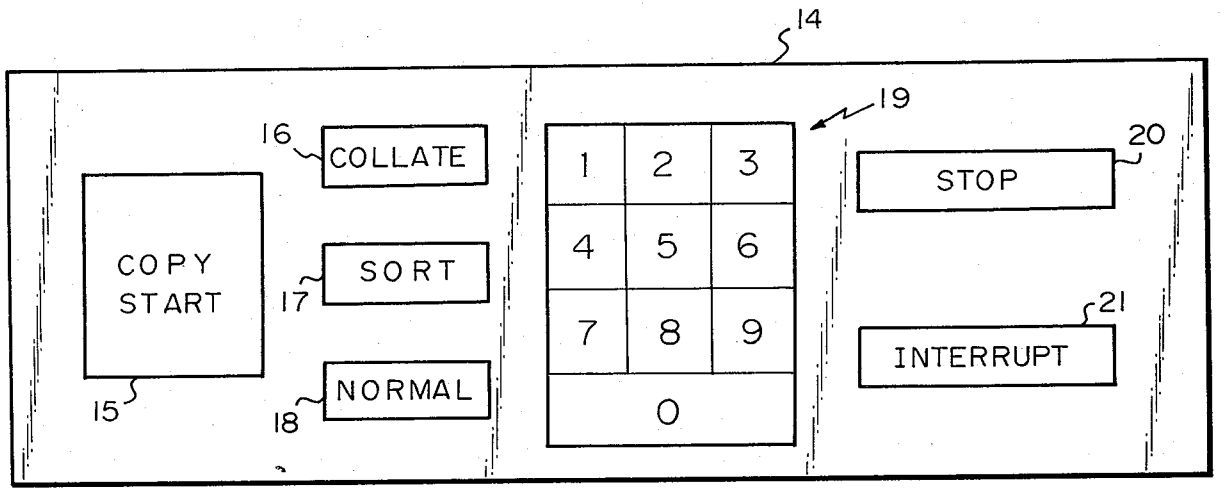
FIG. 2 illustrates a control section of the copying machine.

As viewed in FIG. 2, the control section 14 has a copy start switch 15, a switch 16 for selecting a collation mode, a switch 17 for selecting an assortment mode, a switch 18 for selecting a standard or usual copying mode which will neither collate nor sort copy sheets, ten key switches 19 manipulatable to set a desired number of copies, a switch 20 for stopping a copying operation or cycle of the copying machine 1 and a switch 21 for interrupting the same.

When the operator desires to use the copying system in a collation mode, he will depress the collating or "COLLATE" switch 16 on the control section 14, selected ones of the ten key switches 19 to input the desired number N of copy sheets and finally the "COPY START" switch 15. The copy machine 1 will then deliver "N" copy sheets therefrom to the collator 2 while the collator 2 will have its deflector 12 indexed downward from the top bin 13 to the N-th bin to distribute the copy sheets P one by one thereinto.

For an assortment mode, the operator will depress the sorting or "SORT" switch 17, some of the ten keys 19 to set "N" copy sheets and finally the "COPY START" switch 15. The copying machine will again supply "N" copy sheets to the interconnected collator 2. The collator 2 this time causes the deflector 12 to deliver the "N" copy sheets into a determined bin 13 and thereafter move downward to the next bin.

When the operator desires a usual copying mode and depresses the "NORMAL" switch 18, a guide plate 22 in the collator 2 pivots from its position indicated by a solid line in FIG. 1 to the position indicated by a phantom line. As the operator sets his desired number N of copy sheets through the ten key switches 19 and depresses the copy start switch 15, "N" copy sheets prepared by the copying machine 1 will be commonly passed into the collator but this time onto a discharge tray 23 by way of the re-positioned guide 22.

When the "STOP" switch 20 is depressed during a copying operation in the collation or assortment mode, the machine 1 memorizes the operating mode and the number of sheets as well as others preset before the stop and inhibits the feed of a fresh sheet for a next copying operation. However, it allows only the sheet conveyance section to continuously operate until a sheet or sheets fed before the depression of the switch 20 reach the collator 2. The collator 2 stops its operation after storing the sheets into determined one or ones of the bins 13. Thereafter, the copy start switch 15 will be depressed again so that the copying system regains the conditions of the instant the switch 20 was depressed and becomes ready for another copying operation.

Furthermore, when the "INTERRUPT" switch 21 is depressed during collation or assortment mode of operation, the copying machine 1 memorizes the operating mode, present number of copy sheets and number of copy sheets obtained up to that instant and establishes the usual copying mode while performing the same actions as in the case of the depression of the "STOP" switch 20. In this situation, the preset number of copy sheets and operating mode of the system can be altered temporarily.

When the operator depresses the switch 21 again after such interruption of the operation in the collation or assortment mode, the system regains the previously memorized conditions. The copy start switch 15 will then be depressed to cause the copying machine 1 to start its copying operation in the previous collation or assortment mode.

Figure 3:
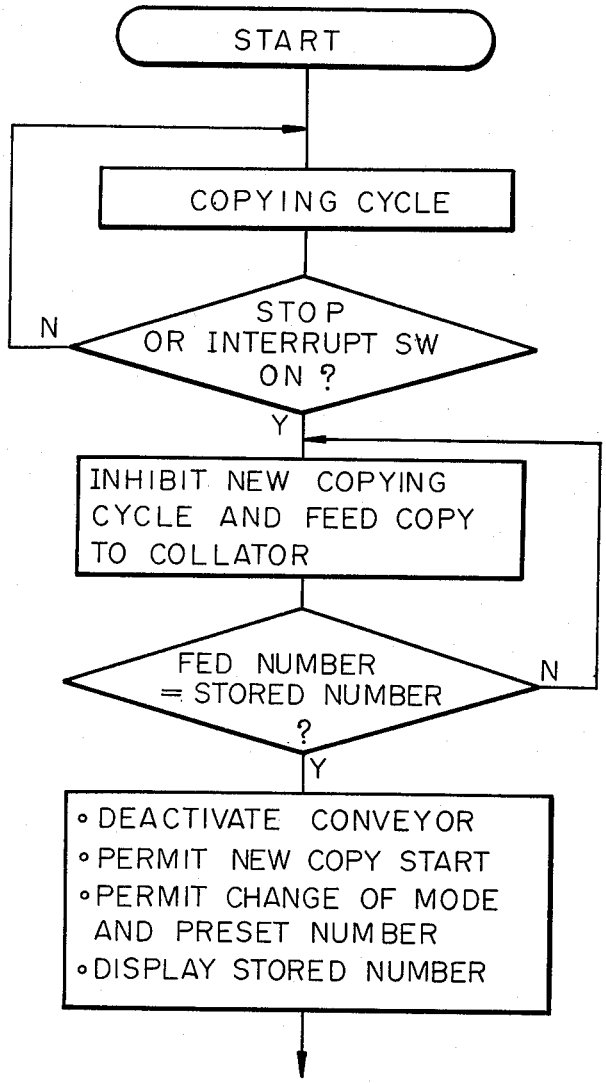
FIG. 3 is a flow chart demonstrating the sheet distribution method and apparatus of the present invention.

After the stop switch 20 or interrupt switch 21 has been depressed during copying operation in the collation or assortment mode, the copying system will be operated as indicated in the flow chart of FIG. 3 in order to permit a start of another copying operation and various actions related therewith.

Referring to FIG. 3, the copying operation continues as long as the switch 20 or 21 remains nondepressed during the collation or assortment mode of operation of the system. Upon depression of the switch 20 or 21, the system inhibits the feed of fresh sheets from the cassette 3 while allowing copy sheets then existing in the machine 1 to reach the collator 2. These sheets which reach the collator 2 will soon be fully stored in selected one or ones of the bins 13, that is, the number of copy sheets stored in the collator 2 will soon coincide with the number of fresh sheets fed from the cassette 3 up to the instant the switch 20 or 21 was depressed. Then the conveyor section is deactivated and various actions are permitted such as another copy start and variation of the operating mode and preset copy number, display of the stored number of copy sheets in the collator on a copy counter display (not shown) and others related with the copy start.

It should be born in mind that the flow chart of FIG. 3 is valid only for the collation or assortment mode of operation of the copying system. In the usual copying mode, when the copying cycle for the final copy completed, the next copy start is permitted. This prevents the copying operation from being slowed down in the usual copying mode.

In summary, it will be seen that the present invention provides an improved sheet distribution method and apparatus which promotes easy and simple processing of a sheet jam if any. As described, when a stop switch or an interrupt switch is depressed during copying operation in a collation mode or an assortment mode of a copying machine, the invention inhibits any further copying cycle of the machine while holding a copy sheet conveyor section alone operative to deliver already fed and processed sheets from the copying machine to a collator. When the number of sheets stored in the collator coincides with the number of fresh sheets fed out of the copying machine, the conveyor section will be deactivated and another copy start and various actions related therewith permitted.

It will also be seen that the present invention prevents a guide plate of the collator from being shifted from one position to the other as a result of a change in the operating mode while sheets are still in conveyance. Such an accidental shift of the guide would direct copy sheets expected to reach bins to a discharge tray and/or create a cause of sheet jams itself.

Various other modifications will become possible for those skilled in the art after receiving the teachings of the present disclosure without departing from the scope thereof.

What is claimed is:

1. A sheet distribution method for distributing a plurality of copies produced by a copying machine during a copying operation or cycle into separate bins of a collating apparatus adjacent to the copying machine, comprising the steps of:

(a) providing at least one of stop switch means to stop the copying operation or cycle in the copying machine and interrupt switch means to interrupt the copying operation or cycle;

(b) when at least one of the switch means is depressed, stopping the copying operation to inhibit production of a next copy or copies while continuing a feeding operation of copy sheets into the bins of the collating apparatus;

(c) when a number of copies fed from the copying machine is equal to a number of copies stored in the bins, stopping the feeding operation; and (d) releasing the copying operation from being stopped to permit production of the next copy or copies.

2. A method as claimed in claim 1, in which the copying operation or cycle includes supplying fresh sheets from a sheet feed station of the copying machine.

3. A method as claimed in claim 1, further comprising the step, following step (b), of:

(e) storing the copying mode and preset number of copies before the depression of the switch means.

4. A method as claimed in claim 3, in which said copying mode is one of a collation mode and a sorting or assortment mode.

5. A method as claimed in claim 3, in which said depressed switch means is the interrupt switch means, further comprising the step, following step (e), of:

(f) storing the copying mode, preset number of copies and number of copies finally copied during copying operation for the interruption.

6. A method as claimed in claim 5, in which step (d) is performed after the interrupt switch means is again depressed.

7. A method as claimed in claim 3, further comprising the step, following step (d), of:

(g) permitting variation of the copying mode and preset number of copies before the switch means is again depressed.

8. A method as claimed in claim 7, further comprising the step of:

(h) indicating a number of copies stored in the bins.

9. A sheet distribution apparatus for use with a copying machine comprising:

a plurality of bins into which a plurality of sets of copies produced by the copying machine during a copying operation or cycle are distributed;

stop switch means for stopping the copying operation or cycle in the copying machine;

interrupt switch means for interrupting the copying operation or cycle;

a first means for inhibiting production of a next copy or copies while continuing a feeding operation of copies into the bins when at least one of the stop switch and interrupt switch means is depressed;

a second means for stopping the feeding operation of the copies when a number of the copies fed from the copying machine is equal to a number of the copies stored in the bins; and a third means for releasing the copying operation from being stopped to permit production of a next copy or copies.

10. A sheet distribution apparatus as claimed in claim 9, in which the copying machine comprises a sheet feed station, the copying operation or cycle including supplying fresh sheets from the sheet feed station.

11. A sheet distribution apparatus as claimed in claim 9, further comprising a fourth means for storing the copying mode and preset number of copies before the depression of the switch means.

12. A sheet distribution apparatus as claimed in claim 11, in which said copying mode is one of a collation mode and a sorting mode.

13. A sheet distribution apparatus as claimed in claim 9, in which said depressed switch means is the interrupt switch means, further comprising a fifth means for storing the copying mode, preset number of copies and number of copies finally copied during copying operation for the interruption.

14. A sheet distribution apparatus as claimed in claim 9, further comprising a sixth means for permitting variation of the copying mode and preset number of copies before the switch means is again depressed.

15. A sheet distribution apparatus as claimed in claim 9, further comprising a seventh means for indicating a number of copies stored in the bins.

* * * * *